US005322026A

United States Patent [19]

Bay

[11] Patent Number: 5,322,026

[45] Date of Patent: Jun. 21, 1994

[54] WASTE COMBUSTION CHAMBER WITH TERTIARY BURNING ZONE

[76] Inventor: Il H. Bay, 426 Tulsa Dr., Ballwin, Mo. 63021

[21] Appl. No.: 994,369

[22] Filed: Dec. 21, 1992

[51] Int. Cl.[5] ..... F23G 5/00

[52] U.S. Cl. ..... 110/235; 110/302; 110/314; 431/165; 431/351; 431/352

[58] Field of Search ..... 110/214, 302, 314, 235; 431/164, 165, 166, 167, 351, 352

[56] References Cited

U.S. PATENT DOCUMENTS

| | | | |
|---|---|---|---|
| 1,565,359 | 12/1925 | Grant | 110/302 |
| 2,059,523 | 11/1936 | Hepburn et al. . | |
| 2,072,731 | 3/1937 | Crosby . | |
| 2,398,654 | 4/1946 | Lubbock et al. . | |
| 2,517,985 | 8/1950 | Davis . | |
| 2,807,316 | 9/1957 | Jackson . | |
| 2,837,893 | 6/1958 | Schirmer . | |
| 2,930,194 | 3/1960 | Perkins . | |
| 2,995,895 | 8/1961 | Howes . | |
| 3,490,230 | 1/1970 | Pillsbury et al. . | |
| 3,567,399 | 3/1971 | Altmann et al. . | |
| 3,593,518 | 7/1971 | Gerrard . | |
| 3,937,007 | 2/1976 | Kappler . | |
| 3,975,141 | 8/1976 | Sweet . | |
| 4,054,028 | 10/1977 | Kawaguchi . | |
| 4,104,017 | 8/1978 | Alin . | |
| 4,109,459 | 8/1978 | Ekstedt . | |
| 4,173,118 | 11/1979 | Kawaguchi . | |
| 4,255,116 | 3/1981 | Zwick . | |
| 4,368,032 | 1/1983 | Araya et al. . | |
| 4,819,438 | 4/1989 | Schultz . | |
| 5,156,097 | 10/1992 | Booth et al. | 110/214 |

FOREIGN PATENT DOCUMENTS

| | | | |
|---|---|---|---|
| 888985 | 12/1943 | France | 431/165 |

*Primary Examiner*—Edward G. Favors

*Attorney, Agent, or Firm*—Haverstock, Garrett and Roberts

[57] ABSTRACT

This invention relates to a combustion chamber and a method for burning waste material, such as waste oil, hazardous chemicals, and municipal garbage or trash, in a manner which generates very little smoke, particulate matter, unburned hydrocarbons, or potentially hazardous fumes in the exhaust gases. The combustion chamber is enclosed within an outer wall which provides an inlet for air, fuel, and burnable waste material, and an outlet for exhaust gases. Enclosed within the outer wall is an annular wall, which divides the chamber into a central burning region inside the annular wall, and an annular space between the outer wall and the annular wall. The central burning region contains a primary burning zone, while the annulus space carries a portion of the inlet air along the length of the chamber.

7 Claims, 4 Drawing Sheets

WASTE COMBUSTION CHAMBER WITH TERTIARY BURNING ZONE

BACKGROUND OF THE INVENTION

This invention involves a combustion chamber designed to burn waste materials, including hazardous chemicals.

Various types of combustion chambers have been developed to burn waste materials such as waste oil, hazardous chemicals, and garbage. One of the primary reasons for burning waste material is simply to dispose of it; however, the burning of waste may also serve as a source of usable heat (for example, it can be used to heat buildings or to generate steam in a manufacturing or chemical processing facility). As used herein, the term "burning" is interchangeable with "combustion."

It is widely known that complete combustion, which reduces air pollutants and increases energy output, can be promoted by increasing the mixing of the burning material with an oxygen-containing gas such as air or purified oxygen. Along those lines, various devices and components have been incorporated into combustion chambers to increase the air-fuel mixing inside those chambers.

For example, the combustion chamber shown in U.S. Pat. No. 2,072,731 (Crosby, 1937) contains two burning zones, which can be regarded as a primary burning zone and a secondary burning zone. Fresh air is slightly compressed by a fan near one end of the chamber. Part of the air enters a central burning chamber through a first set of inlets. The central burning chamber contains a spray nozzle near the inlet, which injects the fuel into the chamber in small droplets. The fuel is ignited by a spark plug and burns, thereby creating a primary burning zone near the spray nozzle. The remaining portion of the fresh air enters an annulus which surrounds the central chamber. The air passing through the annulus is heated by the high temperatures in the central burning chamber. After being heated, the air enters the central chamber through orifices near the outlet of the device, which pass through the wall that separates the central chamber from the annulus. A secondary burning zone is created when the heated air enters the central chamber and mixes with the partially burned fuel.

Another combustion device is described in U.S. Pat. No. 2,059,523 (Hepburn et al, 1936). In that device, outside air is drawn into a secondary burning zone by means of a draft-producing device at the end of the combustion tube.

U.S. Pat. No. 4,054,028 (Kawaguchi, 1977) describes a combustion device similar to the device of Crosby, except that the air which enters the annulus does not enter the internal burning chamber through numerous small orifices. Instead, it enters the chamber through a small number of "scoops" placed in two distinct stages. Fresh air enters through a primary inlet which surrounds a fuel spray nozzle. The primary burning zone is immediately downstream from the spray nozzle. The secondary burning zone is created by a first set of scoops, which convey heated air from the annulus into the central burning chamber. A second set of scoops also serve as passageways for fresh air; however, those scoops do not create a tertiary burning zone. Instead, they create a dilution zone which assertedly controls the temperatures generated in the combustion chamber, and which presumably reduces the temperatures of the exhaust gases.

The Kawaguchi system can also contain various devices to promote air-fuel mixing, such as (1) angled blades in the primary air inlet, to generate a swirling action in the primary burning zone; (2) baffle disks between the primary and secondary burning zones, to generate turbulence and mixing; and (3) air scoops which are slanted in the upstream direction to generate turbulence and mixing in the secondary burning zone.

U.S. Pat. No. 4,173,118 (also by Kawaguchi, 1979) discloses a similar device with (1) numerous fuel spray nozzles and air inlets, spaced in a circle to create a primary burning zone with an annular rather than circular shape; (2) a water or steam injector in the middle of the primary burning zone, to aid the burning of heavy oil. That system also contains a secondary burning zone, and a dilution and cooling zone, similar to U.S. Pat. No. 4,054,028.

U.S. Pat. No. 2,398,654 (Lubbock et al, 1946) and U.S. Pat. No. 4,819,438 (Schultz 1989) also describe a combustion chambers with primary and secondary burning zones followed by a dilution zone. In the Lubbock patent, the air in the annulus flows in a direction counter to the flow of the exhaust gas, which causes it to be heated before it enters the primary burning zone. In the Schultz patent, steam is circulated around the burning chamber to control the temperature and to obtain a useful work output.

U.S. Pat. No. 3,567,399 (Altmann et al, 1971) discloses an afterburner. Hot waste gases from a primary burning chamber are introduced along with an additional source of fuel such as natural gas which is ignited near the inlet. Air is compressed into an annulus surrounding the afterburner chamber, and enters the afterburner through various orifices which are preferably angled to promote a swirling motion inside the afterburner.

The combustion chambers described above which are designed for burning waste material suffer from various limitations. The more complex devices, such as the burning chambers invented by Kawaguchi, must be assembled from dozens of component parts, which must be manufactured with close tolerances at relatively high expense. In addition, a complex burning devices can be difficult to maintain properly, especially if used to burn waste material having a wide variety of characteristics. The simpler devices such as the burners invented by Crosby, Lubbock, and Schultz do not ensure the desired degree of combustion in some situations, and can cause the emission of smoke, unburned hydrocarbons, and other air pollutants. In addition, none of the devices above are suitable for burning solid wastes.

Other devices have been developed to promote air-fuel mixing in gas turbines and jet engines; for examples, see U.S. Pat. No. 3,593,518 (Gerrard, 1971), U.S. Pat. No. 3,937,007 (Kappler, 1976), and U.S. Pat. No. 2,930,194 (Perkins, 1960). Those are not relevant to the subject invention, for several reasons. Gas turbines and jet engines involve extremely high gas velocities, the internal mechanisms involve rapidly-moving and often delicate components, they are usually operated at very high levels of excess oxygen, and they cost a great deal more to manufacture than waste oil burners.

There is, therefore, a need for a sturdy and inexpensive device for burning waste material, which has no internal moving parts and which can achieve higher levels of combustion of burnable material than previously achieved by other combustion chambers.

One object of this invention is to provide a simple, sturdy, inexpensive, and reliable device for burning waste material.

Another object of this invention is to provide a waste-burning device which can achieve virtually complete combustion of any liquid or liquified input material, such as waste oil, paint sludge, or hazardous chemicals.

Another object of this invention is to provide a device for achieving virtually complete combustion of hazardous chemical wastes, to ensure that very low quantities of toxic, carcinogenic, or otherwise hazardous air pollutants will be emitted into the atmosphere.

Another object of this invention is to provide a device for achieving virtually complete combustion of solid wastes such as old tires and municipal or industrial trash or garbage.

SUMMARY OF THE INVENTION

This invention relates to a combustion chamber and a method for burning waste material, such as waste oil, hazardous chemicals, and municipal garbage or trash, in a manner which generates very little smoke, particulate matter, unburned hydrocarbons, or potentially hazardous fumes in the exhaust gases. The combustion chamber is enclosed within an outer wall which provides an inlet for air, fuel, and burnable waste material, and an outlet for exhaust gases. Enclosed within the outer wall is an annular wall, which divides the chamber into a central burning region inside the annular wall, and an annular space between the outer wall and the annular wall. The central burning region contains a primary burning zone, while the annulus space carries a portion of the inlet air along the length of the chamber. While travelling through the annulus, that air is heated by the high temperatures generated inside the primary burning zone. A portion of the heated air leaves the annulus and enters the central chamber through orifices in the annular wall, thereby generating a secondary burning zone. Another portion of the heated air in the annulus passes through conduits to a centrally-located air injector positioned near the outlet of the chamber, directly in the path of the hot exhaust gases. The heated oxygen-containing air from the annulus enters the air injector and is heated even more before leaving the air injector, which mixes the extremely hot air with the still-burning mixture. This creates a tertiary burning zone at the outlet of the chamber. In addition, since the air injector is positioned directly in the path of the hot exhaust gases, it prevents fast-moving exhaust gases from flowing through the center of the exhaust outlet. This causes unburned material to spend a longer period of time inside the burning chamber, thereby promoting more complete combustion.

DETAILED DESCRIPTION OF THE INVENTION

Figure 1:
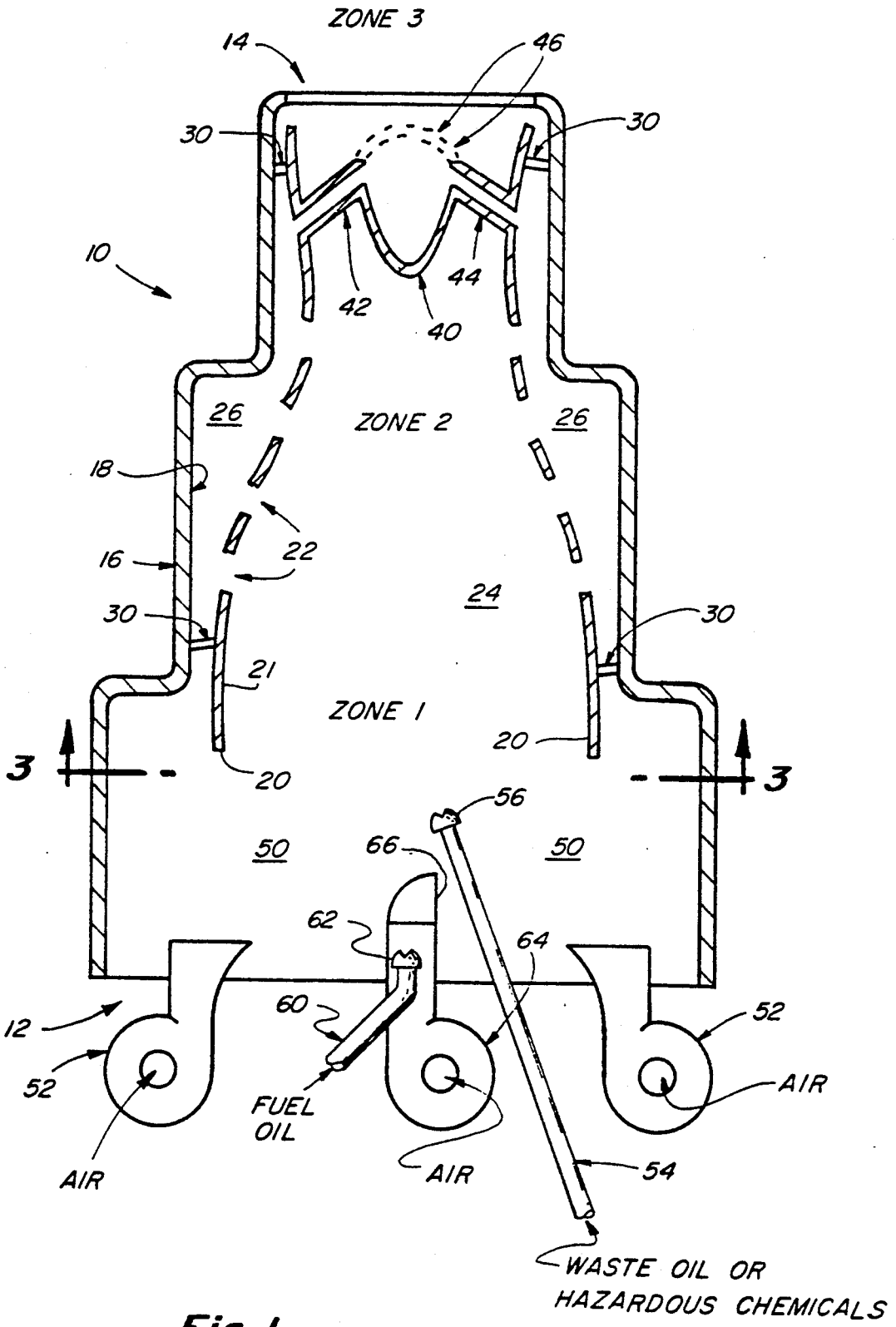
FIG. 1 is a cross-sectional cutaway view of a burning chamber of this invention, in a vertical orientation.

Referring to the drawings more particularly by reference numbers, number 10 in FIG. 1 refers to a burning chamber according to the present invention, designed for burning liquid or liquified wastes such as toxic chemicals or waste oil. Burning chamber 10 is shown in a vertical orientation, with an inlet region 12 near the bottom and an exhaust outlet 14 at the top, so that flow is generally upward through the burning chamber.

Burning chamber 10 is contained within an outer wall 16, which is preferably cylindrical or conical in shape. The cross-sectional dimensions of the exhaust outlet 14 can be smaller than the dimensions of the inlet 12. This can be done in various ways, such as the step-wise reduction shown in FIG. 1, in a gradual fashion using a chamber having a conical shape, or in a modified step-wise fashion using cylindrical segments with tapered conical sections between them. Outer wall 16 can be fabricated from any non-permeable material which will withstand the temperatures generated by burning inside the chamber, such as ASTM A316 steel. If desired, all or a portion of the interior side 18 of outer wall 16 can be lined with a refractory material such as ceramic tiles, to reduce the heat stress on the metal wall and to sustain relatively even high temperatures within the burning chamber.

Figure 2:
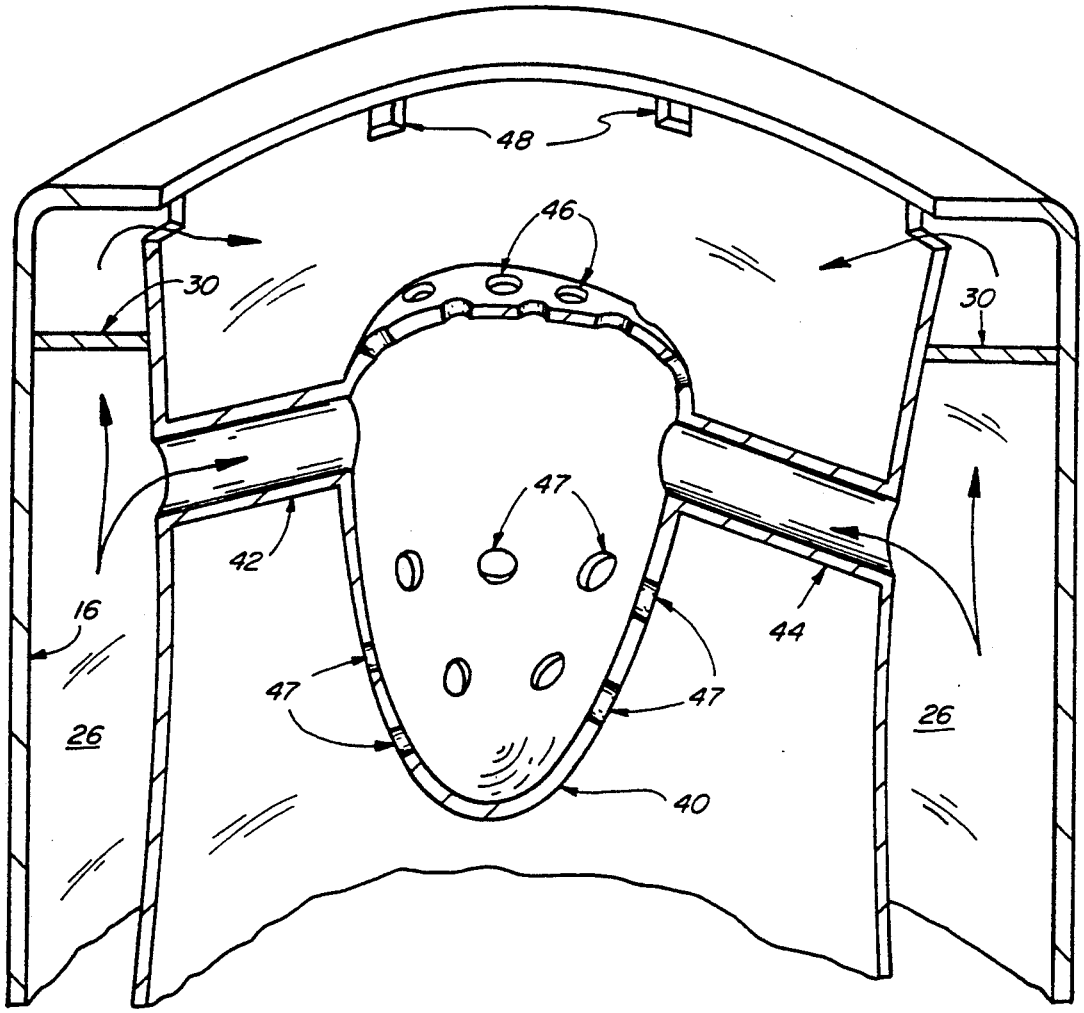
FIG. 2 is an enlarged cutaway view of the air injector of the burning chamber of this invention.

Within outer wall 16 is an annular wall 20 which divides a portion of the burning chamber into a central burning region 24 and an annular space 26. Although the annular wall 20, like the entire chamber 10, preferably has a circular cross-section and is co-axial with the outer wall 16, as shown in FIG. 2, that feature is not essential, and "annulus" and "annular" are used herein to refer to a gap between an outer wall and an inner wall through which air can pass, regardless of the cross-sectional shape.

A plurality of orifices 22 pass through annular wall 20. The orifices 22, which allow air to pass from annular space 26 into central chamber 24, are referred to collectively as the second air inlet 28. The primary inlet, which comprises several components, is described in detail below.

As used herein, for convenience, the term "air" refers to any oxygen-containing gas. The majority of burners used to incinerate waste material use air as the combustion gas. However, it is possible to use partially or completely purified oxygen for certain purposes if desired, such as to fully incinerate extremely toxic materials where very high burning temperatures are necessary, or in locations where nitrogen oxides must be minimized.

Annular wall 20 is connected to outer wall 16 by any suitable means, such as bolts or welded struts 30 near the inlet and outlet ends of annular wall 20. Pressures and velocities will not be high inside the chamber 10; the main structural constraint during fabrication involves the selection of suitable material which can withstand the high temperatures and potentially corrosive conditions generated in the burning chamber. Stainless steel having a thickness of about 0.5 cm or more can be used. The interior side 21 of the annular wall 20 can be lined with ceramic tile if desired.

As described below, central chamber 24 can be regarded as containing two burning zones, designated on FIG. 1 as ZONE 1 and ZONE 2. In one preferred embodiment, there is no physical divider which separates ZONE 1 and ZONE 2. In an alternate preferred embodiment, a set of baffles, angled blades, or other devices can be placed in the transition area between those burning zones to generate additional turbulence and air-fuel mixing.

Figure 3:
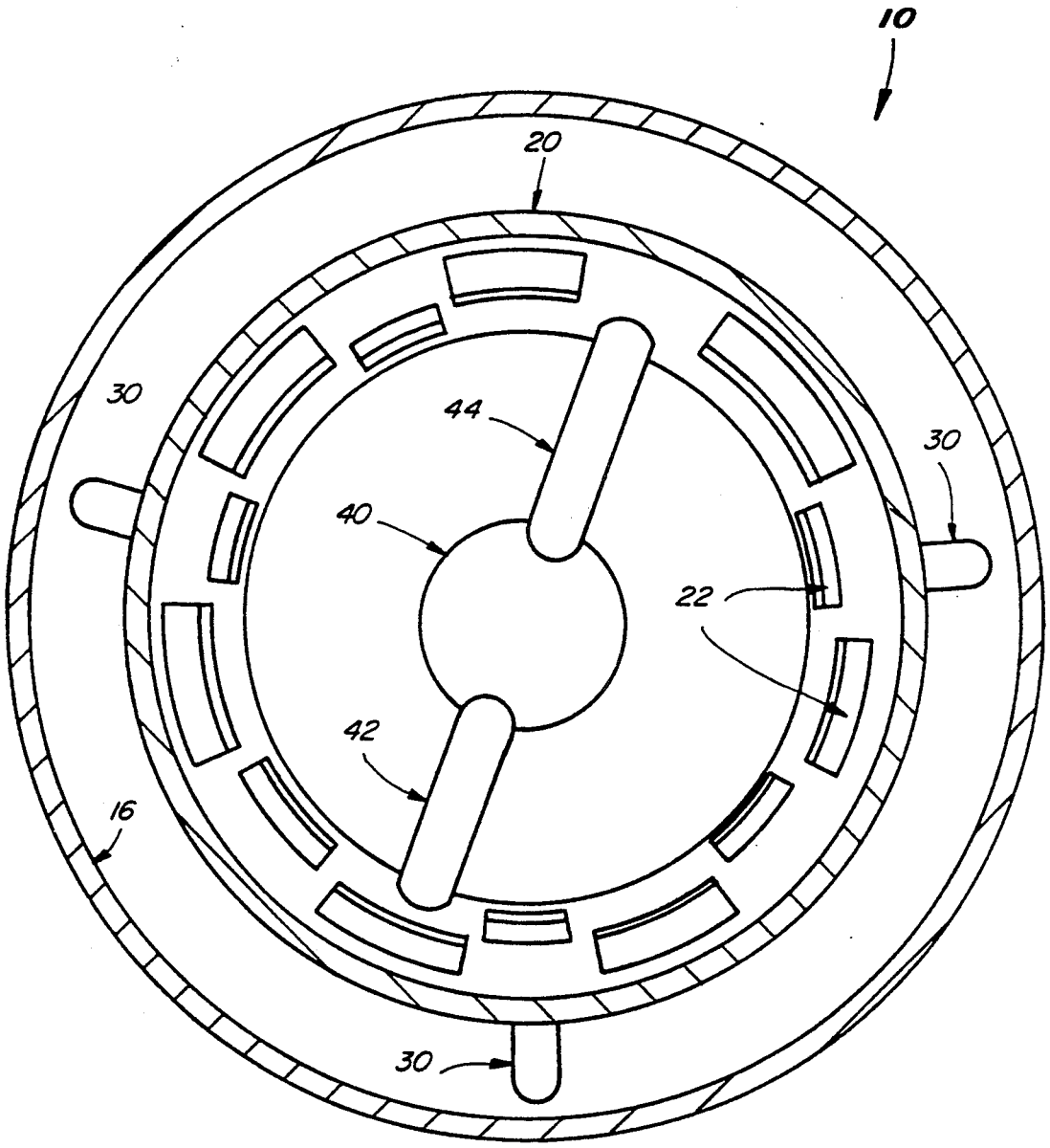
FIG. 3 is a cutaway view of the burning chamber of this invention, looking vertically upward into the primary and secondary burning zones along line 3—3 in FIG. 1.

As shown in FIGS. 1 through 3, an air injection assembly 40 is positioned directly in the path of the hot exhaust gases which are exiting ZONE 2. The main body 40 of the air injector assembly receives heated air from annular space 26 via one or more hollow conduits 42 and 44, which support the injector and hold it in position. The air injector 40 and the air which passes through it become very hot. Multiple perforations 46, on the exhaust (downstream) side of air injector 40, allow the super-heated air to join and mix with the exhaust gas.

Instead of providing a dilution and cooling zone as shown in the combustion chambers of Kawaguchi, Lubbock, and Schultz, the air injector of the subject invention, positioned directly in the path of the exhaust gases so that it mixes superheated air with the exhaust gas, creates a third burning zone designated as ZONE 3 on FIG. 1. When waste materials such as waste oil or discarded tires were burned in a combustion chamber described herein during a test run, a bright flame with an orange color could be seen exiting the burning chamber, when looked at from alongside the chamber. This visible flame exiting the combustion chamber indicated that (1) combustible material remained in the exhaust gases after they passed through the primary and secondary burning zones, and (2) the combustible material, which otherwise would have been released to the atmosphere as air pollutants, was being burned in the tertiary burning zone. The length of the flame in the tertiary burning zone could be controlled by altering the amount of air which entered the primary inlet of the burning chamber. If inlet air was reduced, the flame in the tertiary burning zone was longer.

For example, on one prototype model, perforations were also provided on the "upstream" side of the air injector (i.e., the side which faces the inlets and ZONE 2); these are shown as perforations 47 in FIG. 2. It should be noted that perforations 47 do not direct heated air directly toward the inlet region 12 of the combustion chamber 10; instead, they direct the heated air in an outwardly radial direction, toward the annular wall 20. This promotes greater mixing of the heated air with the partially combusted exhaust gases, and helps retain the partially combusted exhaust gases inside the combustion chamber for a longer period of time, thereby promoting more complete combustion. A double-perforated injector was tested and performed satisfactorily and tended to reduce the amount of noise generated by the combustion chamber.

A plurality of orifices 48 can also be provided between annular wall 20 and outer wall 16 at the exhaust outlet, to promote more mixing in the tertiary burning zone. These gaps 48 should be relatively small in their total area, so that they will not divert too much air flow away from the gas injection device 40. Instead of providing a single gap which extends around the entire periphery or circumference of the outlet, the outlet gaps 48 preferably should comprise a relatively small number of orifices (such as about four to six) which will function as nozzles to increase the rate of flow of hot air radially inward, into the central region of the exhaust outlet area, as shown by the arrows.

Turning now to the inlet region 12 of burning chamber 10, shown in FIG. 1, air inlet regions 50 comprise one or more inlet channels, located around the periphery of the combustion chamber so that the inlet air will be divided between the central burning zone 24 and the annular space 26. Although convection drafts may be sufficient to provide fresh air in some situations, units designed to burn low-grade waste material can be provided with one or more air blowers if desired, such as blowers 52. For small burners, a single blower with an intake manifold which distributes the incoming air around the periphery of the burner inlet can be used. For large burners, it may be desirable to have more than one blower, each of which can be equipped with a flow-directing manifold or other attachment to distribute the air in any desired manner in the combustion chamber. The air can be pre-heated if desired, either before or after it enters the blower(s). For example, the intake air can be passed through inlet ducts placed alongside a portion of outer wall 16 of the combustion chamber; this will pre-heat the air while reducing the outside temperature of the combustion chamber.

Waste oil or other fluid or semi-fluid waste material enters burning chamber 10 via inlet tube 54 and spray nozzle 56, which can be slotted, perforated, or provided with other dissipation means designed to handle the fluids or sludges entering the chamber. If the waste oil is preheated before it enters the chamber, it should be heated by means which minimize the risk of fire or explosion outside the burning chamber, such as heat exchanger tubes or a steam heater.

FIG. 1 shows several optional devices that can be used in conjunction with the burning chamber of this invention if desired, to improve its versatility and performance when low-grade waste oil or low outside temperatures are encountered. Inlet tube 60 coupled to spray nozzle 62 can be used to inject an additional source of fuel (such as #2 fuel oil) into burning chamber 10. This can be useful to help start the combustion process, especially in cold settings. If desired, the fuel oil can be preheated. Spray nozzle 62 can comprise an atomizing or mist-generating nozzle or any other conventional device used to inject fuel oil into combustion devices. Blower 64 can be provided to promote the burning of the fuel oil. Damper 66 can be provided, allowing the fuel oil injection system to be closed off and protected after combustion is started if a continuing supply of fuel oil is not required. If desired, the burning chamber 10 can be equipped with one or more ignition devices such as a spark plug or an electrical resistance coil, preferably downstream of fuel oil spray nozzle 62 and/or waste material spray nozzle 56 and enclosed within damper 66.

Figure 4:
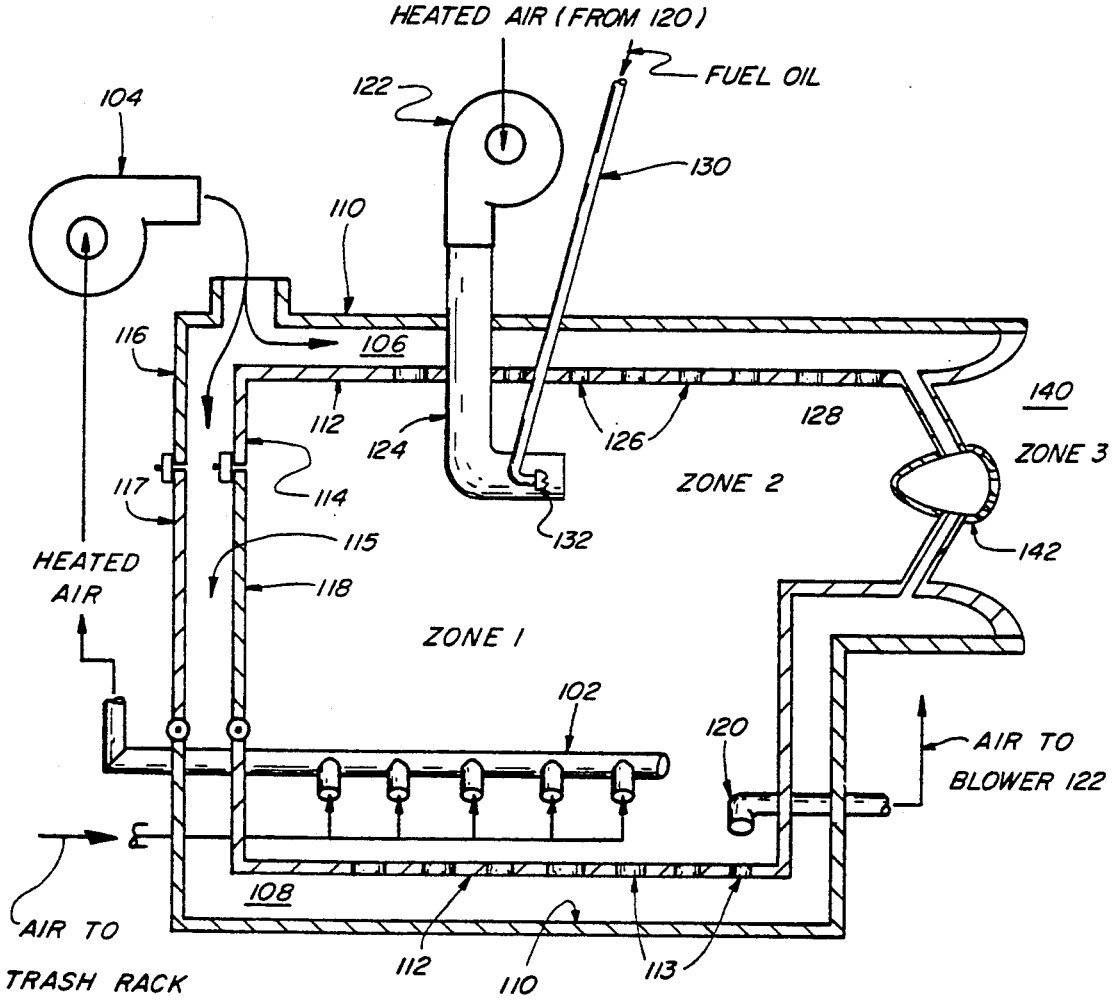
FIG. 4 is a cross-sectional cutaway view of an alternative burning chamber of this invention, designed for the combustion of solid wastes.

An alternate preferred embodiment of the subject invention, shown in a cutaway view as assembly 100 in FIG. 4, has several modifications which make it suitable for burning solid wastes such as discarded tires. The solid waste material is placed on a rack 102, which preferably comprises hollow pipes. Unheated ambient air passes through the pipes; this heats the air and cools the pipe rack 102 to prolong its useful life. The ambient air can be drawn through the pipes by means of blower 104, which creates a suction, or by means of an additional feeder blower upstream of the pipe rack. The heated air which has passed through the pipe rack is used as inlet air for the combustion process. The heated air travels toward the Zone 1 of the combustion chamber via top space 106 and bottom space 108, which have annular shapes in cylindrical combustion chambers, or other shapes in combustion chambers having non-circular exteriors. Annular top space 106 and bottom space 108 are enclosed within a cylindrical outer wall 110, which is generally impermeable, and a cylindrical inner wall 112 which is fitted with air flow orifices 113.

The back wall comprises a double wall, as shown, having internal wall 114 and external wall 116, which enclose a back space 115. Alternately, a single back wall can be used, if an air flow channel is provided to ensure that a sufficient quantity of air reaches bottom annular space 108. Such an air flow channel can be affixed to the inside of a single back wall, or it can pass in one or more directions around the periphery of cylindrical inner wall 112. The air, which has already been heated by passage through the pipe rack 102, will be further heated during its passage through the back space 115 or other air flow channels mounted on the heated inner wall 112 or back wall 114.

Hinged and latchable doors 117 and 118 pass through back walls 114 and 116, or through a side wall if desired, to insert large items of trash to be burned. Alternately, the outlet air flow device 142 (discussed below) can be installed in a removable manner, which will facilitate cleaning and periodic replacement of the super-heated device; if so, trash can be loaded into the chamber through the exhaust channel 140 when the outlet device 142 has been removed. If desired, a door or other movable panel can also be provided on the bottom of the chamber, to facilitate ash removal.

The primary burning zone (ZONE 1) is in the main chamber of the combustion device, and is centered around and above the solid waste which sits on the pipe rack 102 as it burns.

A hot air suction pipe 120 preferably should be provided to draw air out of the burning chamber from a region near the bottom, as shown in FIG. 4. This air is carried via a heat-insulated pipe to blower 122, which injects the heated air via duct 124 into a secondary burning zone (ZONE 2). ZONE 2 is also fed by heated air from top annular space 106, which enters ZONE 2 via orifices 126 which pass through the interior wall 112. Blower 122 also cooperates with fuel oil inlet pipe 130 and spray nozzle 132 to provide an auxiliary source of fuel during the burning process.

The tertiary burning zone (ZONE 3) is created at chamber outlet 140 by an air injector 142 positioned in the path of the hot exhaust gases. It functions in a manner comparable to the air injector on the liquid waste combustion chambers described previously; i.e., it impedes the flow of hot gases through the outlet, thereby increasing the dwell time of unburned particles in the burning zones, and it superheats the air which is mixed with the exhaust gas at the outlet, thereby creating a tertiary burning zone at the outlet of the chamber.

In one preferred embodiment, the exhaust outlet 140 of chamber 100 is located near the top of the chamber rather than being centered along the axis of the chamber. This aids in the recovery of non-burnable material from the solid waste, which accumulates in the chamber as ash.

Thus, there has been shown and described a novel device for burning waste material, and more particularly for ensuring virtually complete combustion of any type of burnable waste with very low levels of noxious or hazardous air pollution. The present invention fulfills all the objects and advantages set forth above. It will be apparent to those skilled in the art, however, that various changes and modifications can be made which do not depart from the spirit and scope of the invention. Such modifications are deemed to be covered by the invention, which is limited only by the claims that follow.

What is claimed is:

1. A combustion chamber for burning liquified waste material, comprising an outer wall which provides at least one inlet capable of receiving liquified combustible material and oxygen-containing gas and an exhaust outlet for releasing combusted exhaust gases, wherein the combustion chamber contains, within the outer wall:

a. an annular wall which divides the combustion chamber into (1) a central burning region inside the annular wall and (2) an annular space between the outer wall and the annular wall, wherein the annular space can serve as a passageway for oxygen-containing gas flowing toward the exhaust outlet of the combustion chamber, and wherein the air flowing through the annular space is heated by combustion which occurs in the central burning chamber, and wherein a plurality of orifices pass through the annular wall, allowing heated oxygen-containing gas to flow from the annular space into the central burning region;

b. a gas injection device having a main body, gas inlet conduits which are in gaseous communication with the annular space, and gas outlet ports, wherein the main body and the gas inlet conduits are positioned near the exhaust outlet of the burning chamber and in the path of the exhaust gases and configured in a manner which causes them to (1) receive heated oxygen-containing gas from the annular space, (2) momentarily hold the heated oxygen-containing gas in the path of hot exhaust gases, thereby further increasing the temperature of the oxygen-containing gas, and (3) release the oxygen-containing gas into the exhaust gases exiting the combustion chamber;

c. a first liquid injection device for introducing liquified waste material into the combustion chamber; and, d. a second liquid injection device for introducing liquified fuel into the combustion chamber to promote combustion of the liquified waste material.

2. The combustion chamber of claim 1 having a circular configuration.

3. The combustion chamber of claim 1 wherein the exhaust outlet has cross-sectional dimensions smaller than the inlet.

4. The combustion chamber of claim 1 wherein some of the gas outlet ports of the gas injection device direct heated gas radially outward from the gas injection device into the path of partially combusted exhaust gas in a manner which causes the heated gas to mix with the partially combusted exhaust gas, while other gas outlet ports of the gas injection device direct heated gas in the direction of the exhaust outlet of the combustion chamber.

5. The combustion chamber of claim 1 wherein a plurality of orifices through the annular wall are provided at the exhaust outlet of the combustion chamber, in a configuration which causes the flow of heated gas into the path of partially combusted exhaust gas in a manner that causes the heated gas to mix with the partially combusted exhaust gas.

6. A combustion chamber suited for burning large items of solid waste, comprising an outer wall which provides (a) a door capable of admitting items of solid waste; (b) an inlet for injecting liquified fuel and oxygen-containing gas into the chamber; and, (c) an exhaust outlet for releasing combusted exhaust gases, wherein the combustion chamber contains, within the outer wall:

a. an annular wall which divides the combustion chamber into (1) a central burning region inside the annular wall and (2) an annular space between the outer wall and the annular wall, wherein the annular space can serve as a passageway for oxygen-containing gas flowing toward the exhaust outlet of the combustion chamber, and wherein the air flowing through the annular space is heated by combustion which occurs in the central burning chamber, and wherein a plurality of orifices pass through the annular wall, allowing heated oxygen-containing gas to flow from the annular space into the central burning region;

b. a gas injection device having a main body, gas inlet conduits which are in gaseous communication with the annular space, and gas outlet ports, wherein the main body and the gas inlet conduits are positioned near the exhaust outlet of the burning chamber and in the path of the exhaust gases and configured in a manner which causes them to (1) receive heated oxygen-containing gas from the annular space, (2) momentarily hold the heated oxygen-containing gas in the path of hot exhaust gases, thereby further increasing the temperature of the oxygen-containing gas, and (3) release the oxygen-containing gas into the exhaust gases exiting the combustion chamber.

7. The combustion chamber of claim 6, wherein solid waste is positioned on top of a rack made of hollow pipes, and wherein a flow path is provided for ambient air to be pumped through the hollow pipes, thereby heating the air and cooling the pipes, prior to pumping the air into the combustion chamber.

* * * * *